US007469507B2

(12) United States Patent
Gerep

(10) Patent No.: US 7,469,507 B2
(45) **Date of Patent: *Dec. 30, 2008**

(54) REFRACTORY SYSTEM HAVING IMPROVED ANCHORING STUD

(75) Inventor: Marcio Gerep, Chattanooga, TN (US)

(73) Assignee: Sage of America, Inc., Ooltewah, TN (US)

( * ) Notice: Subject to any disclaimer, the term of this patent is extended or adjusted under 35 U.S.C. 154(b) by 621 days.

This patent is subject to a terminal disclaimer.

(21) Appl. No.: 10/781,277

(22) Filed: Feb. 18, 2004

(65) Prior Publication Data

US 2004/0163576 A1 Aug. 26, 2004

Related U.S. Application Data

(60) Provisional application No. 60/448,012, filed on Feb. 18, 2003.

(51) Int. Cl.
*E04H 14/00* (2006.01)

(52) U.S. Cl. ..... 52/173.1; 52/379; 52/506.02; 52/513; 52/698; 52/746.6

(58) Field of Classification Search ..... 52/705, 52/166, 506.02, 506.05, 334; 411/386–389; 110/336

See application file for complete search history.

(56) References Cited

U.S. PATENT DOCUMENTS 1,855,620 A * 4/1932 Wilkins et al. ..... 24/135 L
1,884,491 A * 10/1932 Ziemann ..... 403/245
2,075,411 A * 3/1937 Von Mertens ..... 411/453
3,042,161 A * 7/1962 Meyer, Jr. ..... 52/166
3,106,791 A * 10/1963 Ball ..... 36/34 R
3,657,851 A 4/1972 Chambers et al.
4,139,975 A 2/1979 Baker
4,157,001 A 6/1979 Pickles
4,680,908 A 7/1987 Crowley
4,787,185 A * 11/1988 Gascho ..... 52/233
4,936,712 A * 6/1990 Glickman ..... 405/284
5,029,054 A * 7/1991 Trainor ..... 362/153.1
5,107,798 A 4/1992 Gerep
5,867,958 A * 2/1999 Ditka et al. ..... 52/410
6,280,202 B1 * 8/2001 Alden et al. ..... 439/66
6,641,326 B2 * 11/2003 Schilling et al. ..... 403/337
7,322,155 B2 * 1/2008 Gerep ..... 52/173.1

* cited by examiner

*Primary Examiner*—Richard E Chilcot, Jr.
*Assistant Examiner*—Chi Q Nguyen
(74) *Attorney, Agent, or Firm*—Buchanan Ingersoll & Rooney PC

(57) ABSTRACT

A refractory system of the type having a refractory material attached to a wall by anchoring studs has a plurality of improved anchoring studs. These studs have grooves extending from the top toward the bottom of the stud and refractory material in at least some of the grooves. Preferably the grooves are parallel to one another and to a longitudinal centerline through the stud. The studs may have a smooth section on the side wall adjacent the bottom. The bottom may be conical. Spikes may be provided on the top of the stud.

11 Claims, 3 Drawing Sheets

REFRACTORY SYSTEM HAVING IMPROVED ANCHORING STUD

CROSS REFERENCE TO RELATED APPLICATION

This application claims priority from U.S. Provisional Patent Application Ser. No. 60/448,012, filed Feb. 18, 2003.

FIELD OF INVENTION

The invention relates to anchoring elements designed to support refractory concrete and other insulating layers applied on boiler walls and other thermally insulated equipment.

DESCRIPTION OF PRIOR ART

There are several types of furnaces and boilers whose walls need to be protected by a refractory lining. In many constructions the refractory or insulating material is attached to metal walls using cylindrical metal studs also known as bolts or anchors. These anchoring elements are slender metal pieces applied on metal surfaces to provide a means to keep in place different sorts of insulating materials. This insulating media could have been applied by hammering, pouring or other means. The adherence of refractory medium to the anchoring element has a direct impact in the duration of the protected elements as well as in the duration of the elements themselves. One of the most common methods of application of such studs is the stud welding process. But the studs could be attached to the wall by other means such as many other welding processes, threads, clamps and even being inserted into the wall or panel during formation of the wall or panel.

The cylindrical anchors just described hold the refractory by frictional engagement of the refractory material to the surface of the stud. With some materials chemical bonding may also occur to some extent. Another type of stud is used with an anchor or retaining plate or washer. This stud passes through the refractory material and has radial slots or threads to which an anchor or retaining plate is connected. Examples of this type of anchor are disclosed in U.S. Pat. No. 4,139,975 to Baker and U.S. Pat. No. 4,157,001 to Pickles. Chambers et al. disclose a two piece refractory anchor in U.S. Pat. No. 3,657,851. This anchor has a cylindrical stud with a transverse hole. A bend rod passes through the hole to create a pair of arms that extend from the stud.

After the refractory material is applied both components—refractory plus anchoring elements form a solid lining and as long as this lining is kept in place they manage to protect and insulate the elements covered by the lining. When the lining operates under continuous impact of solid particles as in the case of boilers burning coal particles, any gap occurring between the metal anchoring element and the refractory itself becomes a week point that will continuously grow under the bombardment causing the refractory to fail, thus exposing the anchoring element and ultimately damaging the lining and exposing the elements meant to be protected.

Refractory holders having studs with anchors and retaining washers on the exposed surface of the refractory can fail when the washer or anchor is eroded or corroded by continuous bombardment of particles passing through the furnace. Consequently, cylindrical studs having only the tip of the stud or less exposed to the interior of the furnace are commonly used.

There is a need for a stud for anchoring refractory material which provides better adherence between the refractory material and the stud. Such improved adherence will enable the refractory liner to better withstand bombardment of particles without the refractory separating from the furnace wall.

SUMMARY OF THE INVENTION

I provide an improved anchoring stud and refractory system containing such studs. The improved stud is generally cylindrical and has a plurality of longitudinal grooves on the exterior surface. The grooves improve the adherence of the concrete to the stud and provide improved heat transfer.

In a second embodiment, the stud has a combination of longitudinal grooves and either or both of radial grooves and diagonal grooves. This combination may provide a knurled outer surface.

A third present preferred embodiment is similar to the first present preferred embodiment except that the grooves do not extend the full length of the side. There is a smooth section near the bottom of the stud that serves as a warning to the user. When the upper portion of the stud has worn down to the smooth section, it is time to replace the stud. This stud preferably has a conical bottom that minimizes the amperage required to weld the stud to a furnace wall. The top of the stud may have a series of spikes which provide improved heat transfer.

Other objects and advantages of the invention will become apparent from the description of certain present embodiments shown in the figures.

BRIEF DESCRIPTION OF THE FIGS.

DESCRIPTION OF THE PREFERRED EMBODIMENTS

Figure 1:
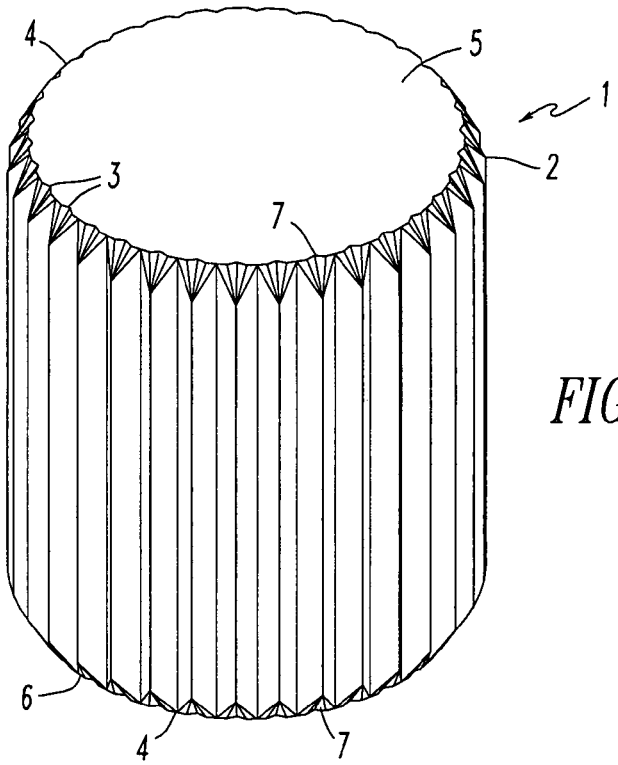
FIG. 1 is a perspective view of a present preferred anchoring stud.
Figure 2:
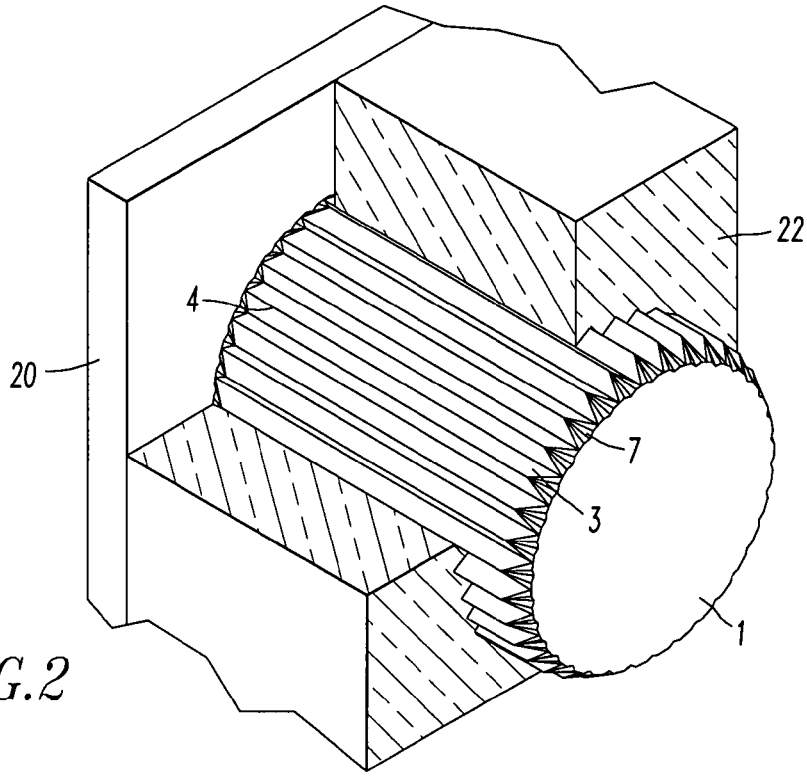
FIG. 2 is a fragmentary view of a portion of a refractory system utilizing the anchoring stud of FIG. 1.

The main characteristic of this new design is that the anchoring element has a surface that is made rough by design to improve the adherence of the concrete or other insulating material to the anchoring element. In a present preferred embodiment shown in FIG. 1 the anchoring stud 1 has an elongated cylindrical body 2 with a series of longitudinal grooves 3 and ridges 4 creating a rough exterior surface. In the preferred embodiment grooves 3 and ridges 4 extend fully from the top 5 of the stud 1 to the bottom 6 of the stud. Other grooves 7 are provided that extend from the ends of the stud only a short distance rather than extend the full length of the stud. It is not necessary that any of the grooves or the ridges extend the full length of the stud or that any groove extend all the way to the top or bottom of the stud. All that is necessary is that the grooves provide an irregular surface that will be in contact with the insulating material. As shown in FIG. 2, when either the top or the bottom of the stud 1 is attached to a furnace wall 20 that is covered with a refractory or other insulating material 22, that material will fill at least some of the grooves 3. Offering the refractory material a large number of irregularities in the metal surface greatly enhances the adhesion between the refractory and the anchoring element.

These irregularities can double or even triple the contact surface between the stud and the refractory material as compared to a conventional stud of the same height and having smooth surfaces. The increase in surface area also increases the heat exchange area of the stud. The configuration of stud 1 provides several advantages in addition to improved adhesion. Longitudinal grooves are easy to cut. The grooves could be cut after the stud is cut to the desired height or the grooves can be cut in long rods that are chopped into multiple studs.

The studs can be any desired length and made of low carbon steel or other metal alloy of the type used for conventional studs. The stud could also be a jacketed stud of the type disclosed in U.S. Pat. No. 5,107,798, the content thereof is hereby incorporated by reference. When new the studs will typically be ⅜ inch (0.95 cm) or ½ inch (1.27 cm) in diameter and ¾ inches (1.91 cm) in length. The grooves preferably are 0.060 inches (0.15 cm) deep and 0.060 inches (0.15 cm) wide. The grooves and ridges may be cut to have flat sides, that meet at sharp angles or they may be rounded. If desired, the exterior surface of the stud may be coated with a corrosion resistant or wear resistant material such as chromium or aluminum. Studs having only longitudinal grooves are easy to uniformly coat with a metal diffusion process.

Although I may provide a stud with only longitudinal grooves, other groove patterns could be used. Furthermore, the longitudinal surfaces of the grooves and ribs need not be flat along their length. Instead they may undulate or be otherwise irregular. Indeed, I prefer to provide a knurled surface which appears to be better suited to resist attempts to separate the anchoring element from the refractory material regardless of the direction of the force attempting to separate them.

Figure 3:
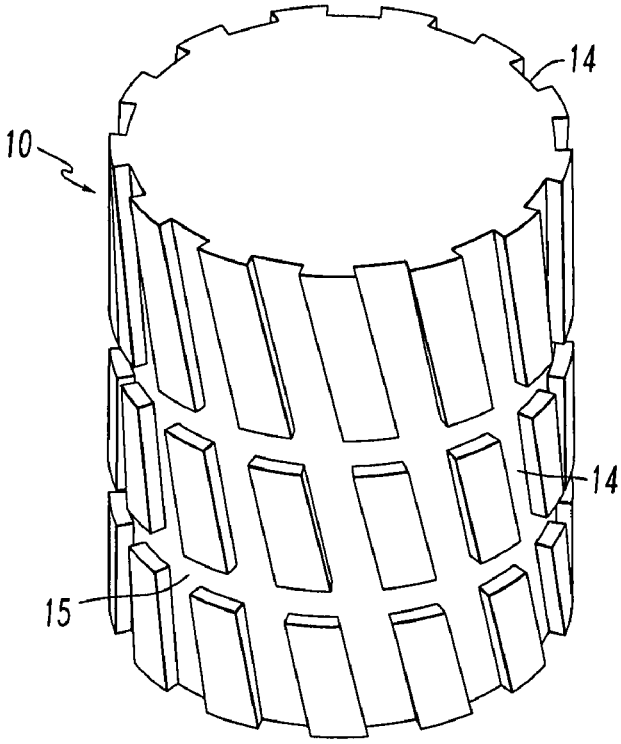
FIG. 3 is a perspective view of a second present preferred anchoring stud.

In a second present preferred stud 10 shown in FIG. 3, the side of the stud has diagonal grooves 14 and circumferential grooves 15. These grooves will be filled with refractory material when the wall bearing the studs is covered with the refractory material. If desired, other combinations of groove patterns such as longitudinal and circumferential, or longitudinal and diagonal or longitudinal, diagonal and circumferential could be used. Moreover, any or all of the grooves or ridges could be wavy rather than straight. Whatever pattern of grooves is selected improved adhesion between stud and refractory will result. Because improved adhesion prevents gradual separation of the elements the expected life of all components involved is greatly improved.

Figure 4:
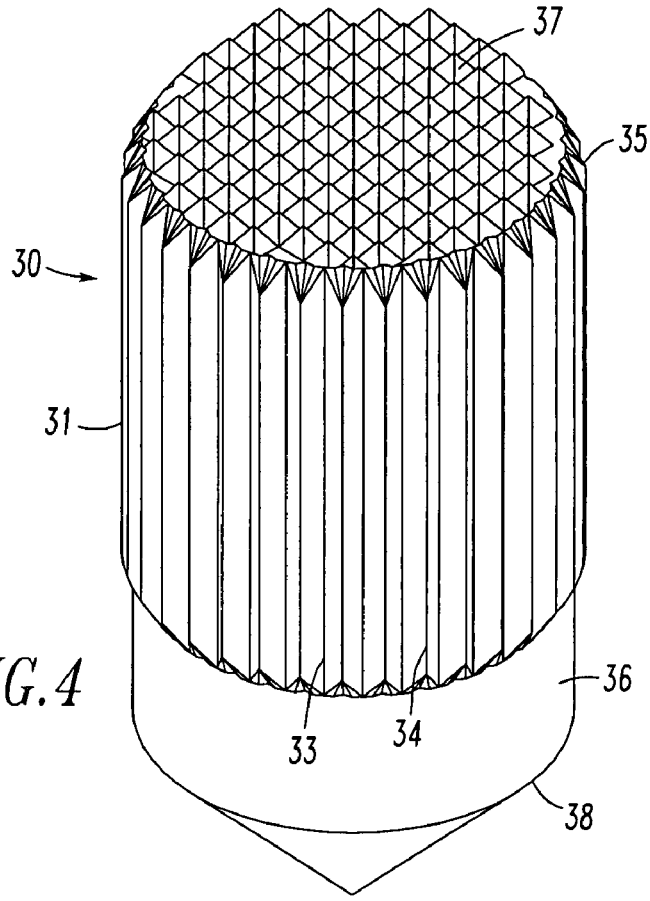
FIG. 4 is a perspective view of a third present preferred anchoring stud.
Figure 5:
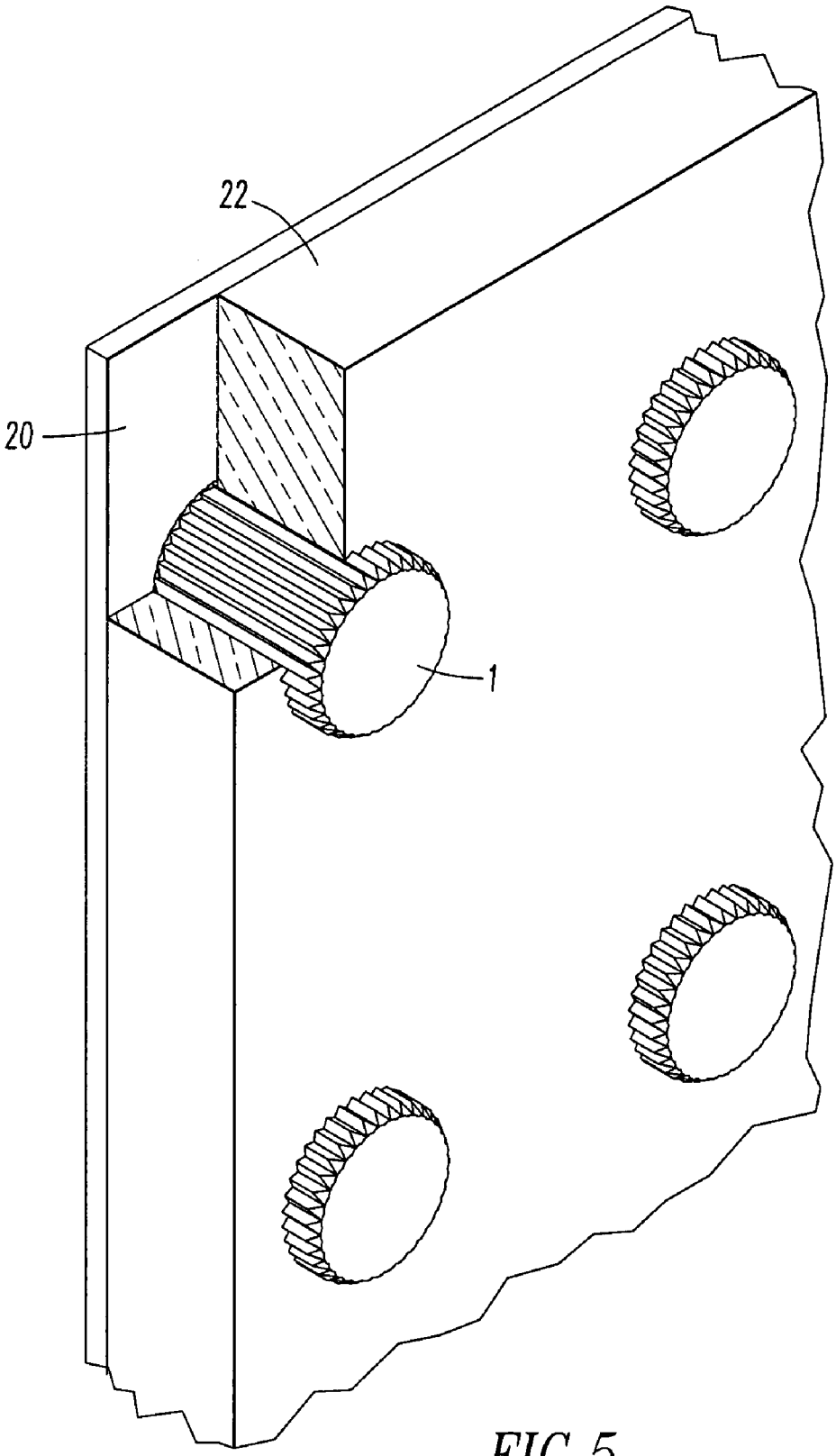
FIG. 5 is a perspective view of a portion of the refractory system shown in FIG. 2 containing four of the anchoring studs.

A third present embodiment of my stud is shown in FIG. 4. This stud 30 has a generally cylindrical body 31 with a series of grooves 33 and ridges 34 extending from the top 35 of the stud. The grooves 33 and ridges 34 do not extend the full length of the stud. There is a smooth section 36 near the bottom 38 of the stud. This smooth section serves as a warning to the user. When the upper portion of the stud has worn down to the smooth section, it is time to replace the stud. The conical bottom 38 of the stud is welded to a furnace wall. The conical shape minimizes the amperage required to weld the stud to a furnace wall. The top 35 of the stud 30 has a series of spikes 37. The spikes increase the heat exchange surface of the studs. In addition, the spikes and ribs enable a thicker diffusion coating of chromium or other corrosion or erosion resistant materials to be applied to the surface of the stud, While the preferred embodiments are generally cylindrical studs having a circular cross section, the present invention is not so limited. The word cylindrical is used in its broadest sense. The cross-section of the stud could be oval or any polygon. Furthermore, what has been here described as a stud could be identified by some as a fin or other component. Consequently, stud as used here may refer to any structure found on a furnace wall or boiler wall that is used to anchor refractory or insulation materials.

In the preferred embodiments concrete is applied to the wall as a refractory material. But, other insulating materials including ceramics and even slag which forms on furnace or boiler walls could be used.

Although I have disclosed certain present preferred embodiments of my anchoring stud and refractory system containing such stud, it should be distinctly understood that the invention is not limited thereto but may be variously embodied within the scope of the following claims.

I claim:

1. A refractory system comprised of a wall, a plurality of anchoring studs attached to the wall, and a refractory material attached to the wall by the anchoring studs, at least some of the anchoring studs comprised of a cylindrical body having a top, a bottom and a side wall extending from the top to the bottom, the side wall having a plurality of grooves extending from the top toward the bottom and refractory material being in at least some of the grooves.

2. The refractory system of claim 1 wherein at least some of the grooves are parallel to a longitudinal centerline through the stud and parallel to one another.

3. The refractory system of claim 1 wherein the studs are low carbon steel.

4. The refractory system of claim 1 also comprising a corrosion resistant or erosion resistant coating applied to at least a portion of the body of each stud.

5. The refractory system of claim 1 wherein at least some of the studs have a cross-sectional shape selected from the group consisting of a circle, an oval and a polygon.

6. The refractory system of claim 1 wherein the refractory material is cement or a ceramic.

7. An insulated wall comprised of a wall, a plurality of anchoring studs attached to the wall and an insulating material attached to the wall by the anchoring studs, at least some of the anchoring studs comprised of a cylindrical body having a top, a bottom and a side wall extending from the top toward the bottom, the side wall having a plurality of grooves, at least some of the grooves extending from the top to the bottom of the cylindrical body and the insulating material being in at least some of the grooves.

8. The insulated wall of claim 7 wherein at least some of the grooves are parallel to a longitudinal centerline through the stud and parallel to one another.

9. The insulated wall of claim 7 wherein the studs are low carbon steel.

10. The insulated wall of claim 7 also comprising a corrosion resistant or erosion resistant coating applied to at least a portion of the body of each stud.

11. The insulated wall of claim 7 wherein at least some of the studs have a cross-sectional shape selected from the group consisting of a circle, an oval and a polygon.

* * * * *